US007175447B2

(12) United States Patent
Pan

(10) Patent No.: US 7,175,447 B2
(45) Date of Patent: Feb. 13, 2007

(54) BACKPLANE CONNECTOR

(75) Inventor: Feng Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,873

(22) Filed: Dec. 30, 2005

(65) Prior Publication Data

US 2006/0281346 A1 Dec. 14, 2006

(30) Foreign Application Priority Data

Jun. 10, 2005 (CN) ..... 2005 2 0072626

(51) Int. Cl.
*H01R 12/00* (2006.01)

(52) U.S. Cl. ..... 439/79; 439/943

(58) Field of Classification Search ..... 439/79, 439/943

See application file for complete search history.

(56) References Cited

U.S. PATENT DOCUMENTS 5,133,679 A * 7/1992 Fusselman et al. ..... 439/608
5,320,549 A * 6/1994 Schempp et al. ..... 439/246
5,453,016 A * 9/1995 Clark et al. ..... 439/79
5,468,154 A * 11/1995 Yip et al. ..... 439/79
5,639,250 A * 6/1997 Neef et al. ..... 439/79
5,672,064 A * 9/1997 Provencher et al. ..... 439/79
5,743,765 A * 4/1998 Andrews et al. ..... 439/608
5,785,537 A * 7/1998 Donahue et al. ..... 439/79
5,931,687 A * 8/1999 McFarlane et al. ..... 439/79
5,971,774 A * 10/1999 Kuki et al. ..... 439/79
6,109,933 A * 8/2000 Lenoir et al. ..... 439/79
6,210,180 B1 * 4/2001 Lee et al. ..... 439/79
6,261,107 B1 * 7/2001 Takase et al. ..... 439/79
6,447,307 B1 * 9/2002 Wu ..... 439/79
6,517,386 B2 * 2/2003 Sakakura et al. ..... 439/676
6,530,786 B2 * 3/2003 Ishikawa ..... 439/79
6,736,676 B2 * 5/2004 Zhang et al. ..... 439/607

* cited by examiner

*Primary Examiner*—Gary F. Paumen
(74) *Attorney, Agent, or Firm*—Wei Te Chung

(57) ABSTRACT

A backplane connector includes an insulative housing (1) defining a number of terminal holes (11), a number of conductive terminals (5), a press block (3) and a spacer (7). Each of the conductive terminals has a mating portion (50) received in the insulative housing, a bending portion (55) extending from the mating portion, a shoulder (57) and a mounting portion (59) mounted on a printed circuit board. The press block has a number of partition walls (37) and a number of slots (39) defined by the partition walls. The spacer defines a number of spacer holes (71) for receiving the shoulders of the conductive terminals to position the conductive terminals. The spacer forms at least one barrier (73) received in the slot and holding the partition walls of the press block in place.

11 Claims, 7 Drawing Sheets

BACKPLANE CONNECTOR

BACKGROUND OF THE INVENTION

1. Field of the Invention

The present invention relates to a backplane connector, and more particularly to a right-angled backplane connector to be mounting on a printed circuit board.

2. Description of the Prior Art

U.S. Pat. No. 5,453,016, issued on Jul. 12, 1994, titled "right angle electrical connector and insertion tool thereof", discloses a right angle electrical connector for being mounted onto a print circuit board. The right angle electrical connector comprises an insulative housing, a plurality of contacts and a press block. Tails of a second, a third and a fourth row of the contacts each have shoulders that are pressed into pockets in the press block. The press block is provided with a corner having a radius matching the radius of tails of a first row.

However, the tails of the contacts are subject to a large counter-insert force, when an insert force is exerted to the press block to thereby press the contacts engaging the print circuit board. It is easily that the shoulders of the contacts slip to the press block to deform lateral walls and partition walls of the press block. Thus, an electrical connection between the tails of the contacts and the printed circuit board becomes invalid. In addition, the corner of the press block is employed for providing a bearing area on both sides of the tails of the first row and transmitting the insert force to the tails of the first row. This structure of the press block and the contacts in the fist row are complex for manufacturing.

Hence, an improved backplane connector is needed to solve the above problems.

BRIEF SUMMARY OF THE INVENTION

An object of the invention is to provide a backplane connector to ensure conductive terminals to be mounted in the backplane connector firmly to thereby maintain a steady electrical connection between the connector and a print circuit board on which the connector is located.

Another object of the invention is to provide a backplane connector with a good structure stiffness.

In order to attain the objects above mentioned, a backplane connector in accordance with the present invention which is adapted for mounting on a print circuit board, includes an insulative housing defining a number of terminal holes, a number of conductive terminals, a press block and a spacer. Each of the conductive terminals has a mating portion received in the insulative housing, a bending portion extending from the mating portion, a shoulder and a mounting portion mounted on a printed circuit board. The press block has a number of partition walls and a number of slots defined by the partition walls. The spacer defines a number of spacer holes for receiving the shoulders of the conductive terminals to position the conductive terminals. The spacer forms at least one barrier received in the slot and holding the partition walls of the press block in place.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
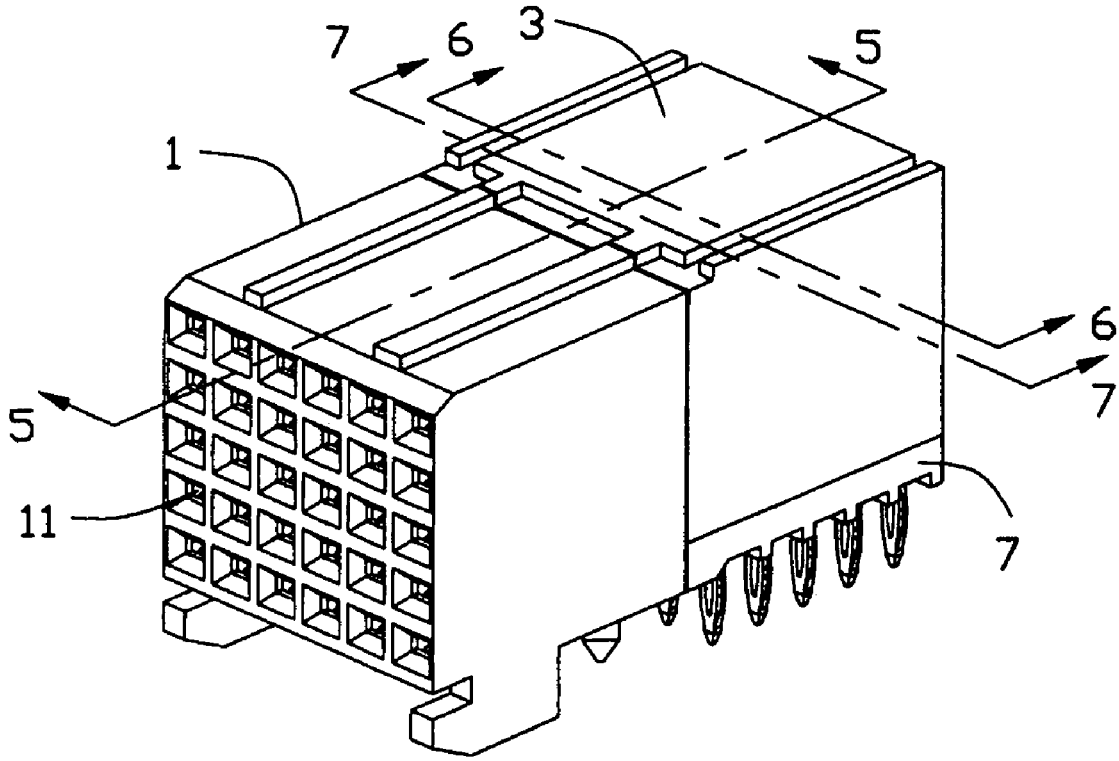
FIG. 1 is an assembled view of a backplane connector of the present invention.

Reference will now be made to the drawing figures to describe the present invention in detail.

Figure 2:
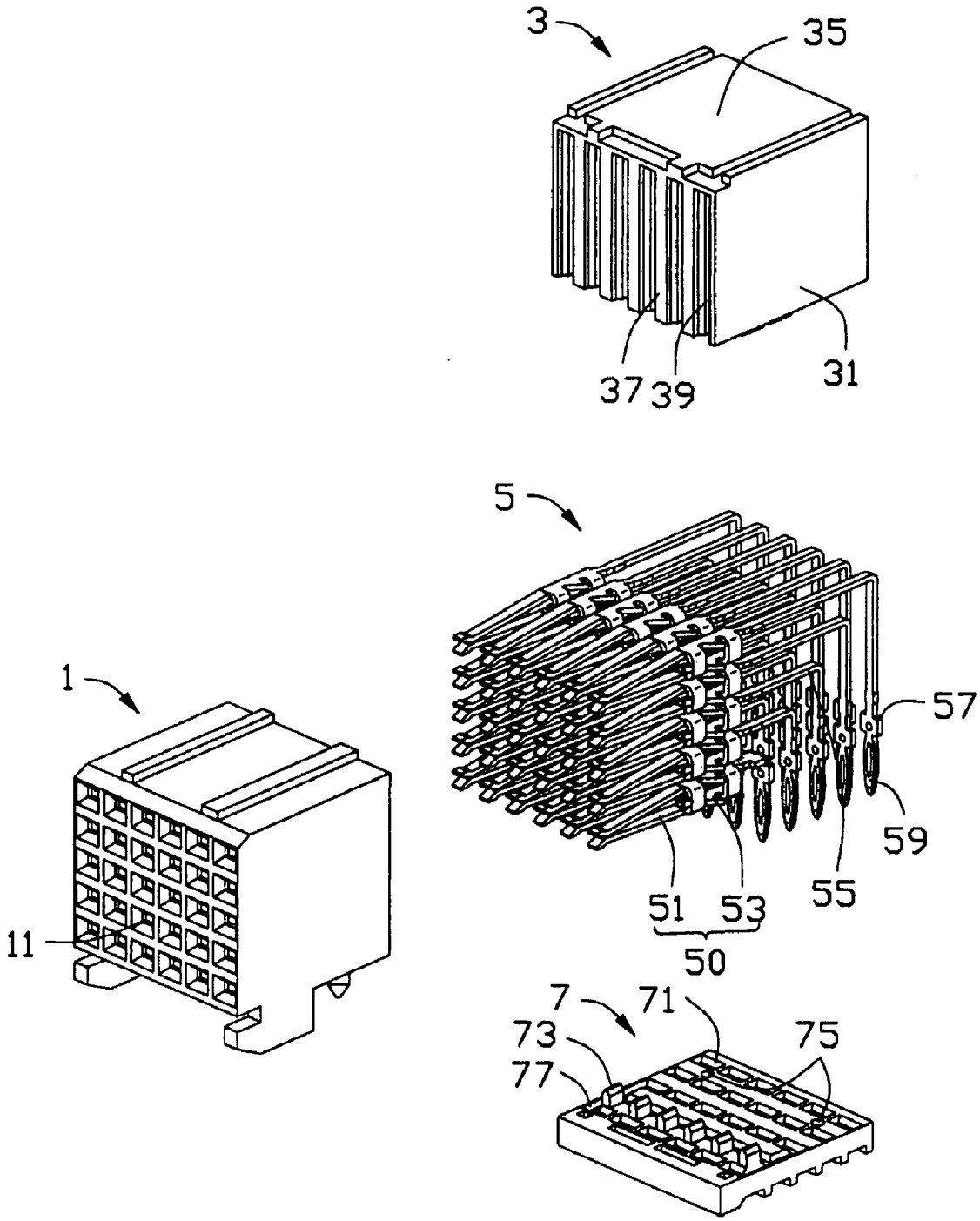
FIG. 2 is an exploded view of the backplane connector shown in FIG. 1.
Figure 3:
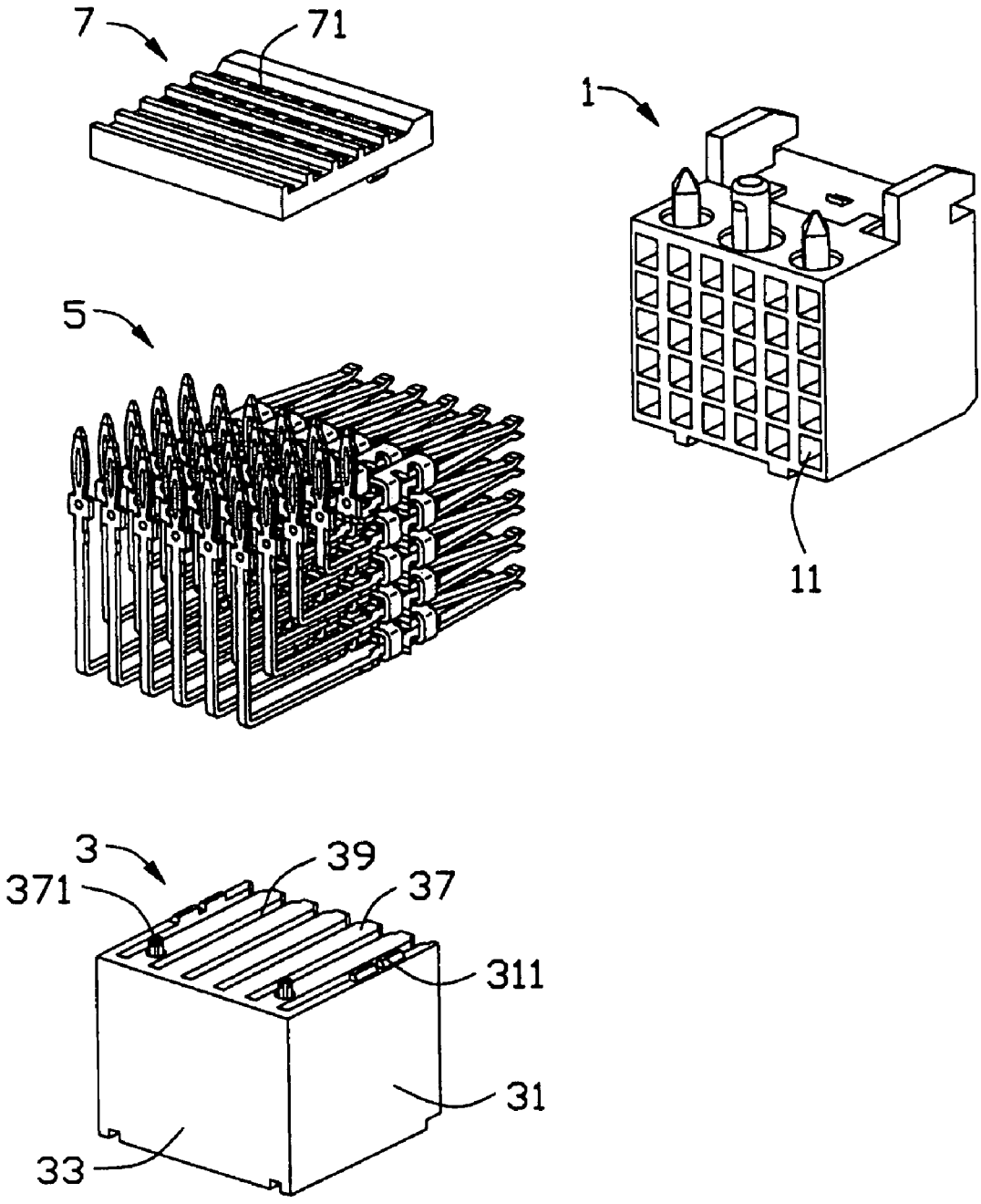
FIG. 3 is an another exploded view of the backplane connector shown in FIG. 1.

Referring to FIGS. 1–3, a backplane connector in accordance with the present invention comprises an insulative housing 1 defining a plurality of terminal holes 11, a press block 3, a plurality of conductive terminals 5 and a spacer 7 assembled to the press block 3.

The press block 3 forms comprises a rear wall 33, a pair of lateral walls 31 perpendicularly extending from two opposite ends of the rear wall 33, a plurality of partition walls 37 parallel to the lateral walls 31, and a top wall 35. The partition walls 37 and the lateral walls 31 define a plurality of receiving slots 39 for receiving the conductive terminals 5. In addition, a pair of protruding blocks 311 are formed on a bottom surface of the lateral walls 31 of the press block 3. A pair of press portions 371 are formed on a bottom of the partition walls 37 that are close to the lateral walls 31.

Figure 4:
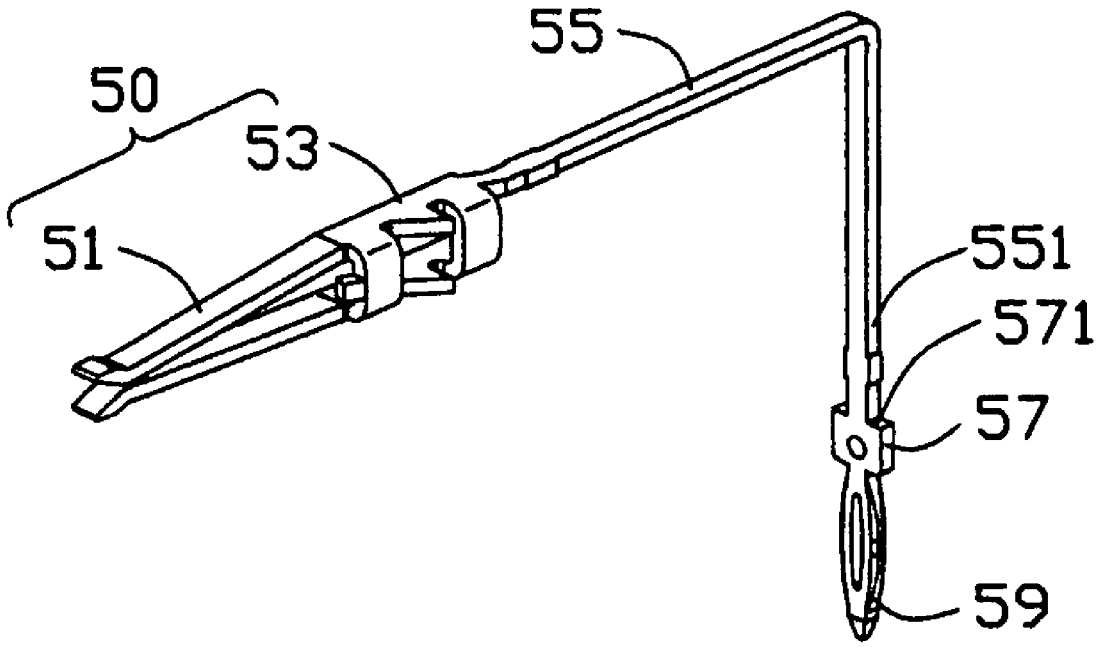
FIG. 4 is a perspective view of a terminal of the backplane connector.

Turn to FIG. 4, each of the conductive terminals 5 comprises a mating portion 50 retained in the corresponding terminal hole 11 of the insulative housing 1, a bending portion 55 extending from the mating portion 50 which retains in the press block 3, a mounting portion 59 extending outside for mounting on a printed circuit board (not shown) and a shoulder 57 formed between the mounting portion 59 and the bending portion 55. A bending angle of the bending portion 55 is 90 degree approximately. In addition, the mating portion 50 comprises a connecting portion 51 engaging with a mating connector (not shown) and a fixing portion 53 extending from the connecting portion 51 which retains in the terminal hole 11. The angle between a top surface 571 of the shoulder 57 and a lateral surface 551 of the bending portion 55 is smaller than or equivalent to 90 degree.

The spacer 7 comprises a plurality of rows of spacer holes 71 for receiving the shoulders 57, a plurality of barriers 73, positioning portion, retaining member or positioning devices formed between a first and a second row of the spacer holes 71, which are used for engaging with the receiving slots 39, and a pair of slant walls 77 formed on the outmost side of the barriers 73. A pair of wedge-shaped slots 81 (FIG. 6) defined between the slant walls 77 and the barriers 73 are employed for receiving the protruding blocks 311 of the press block 3. In addition, the spacer 7 further comprises a pair of press slots 75 engaging with the press portions 371 of the press block 3.

Figure 5:
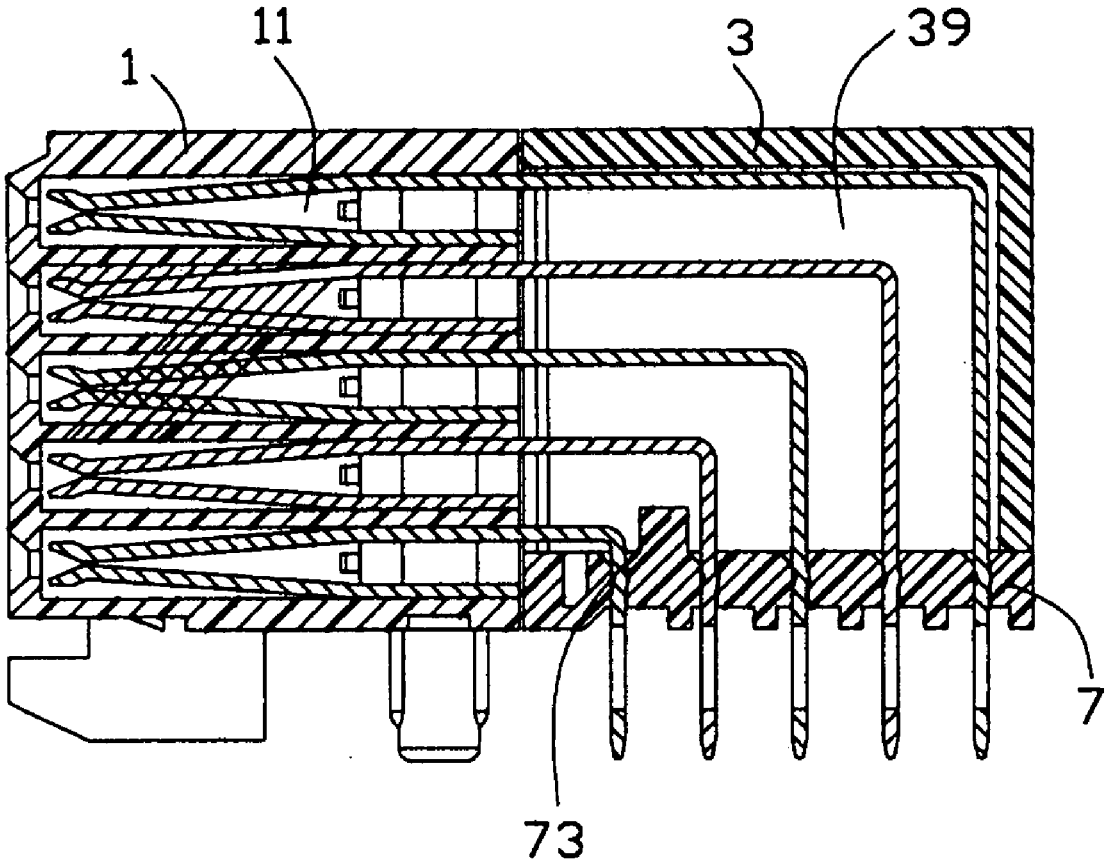
FIG. 5 is a sectional view of the backplane connector taken along line 5—5 in FIG. 1.
Figure 6:
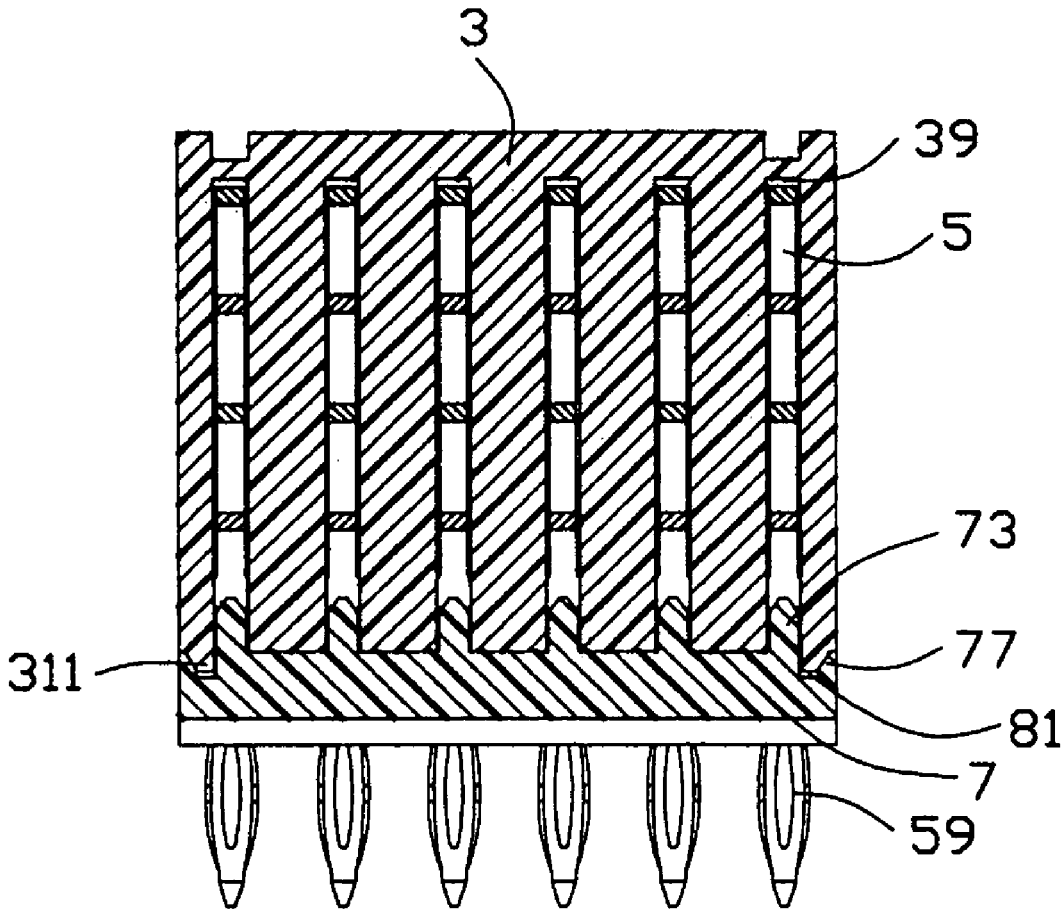
FIG. 6 is a sectional view of the backplane connector taken along line 6—6 in FIG. 1.
Figure 7:
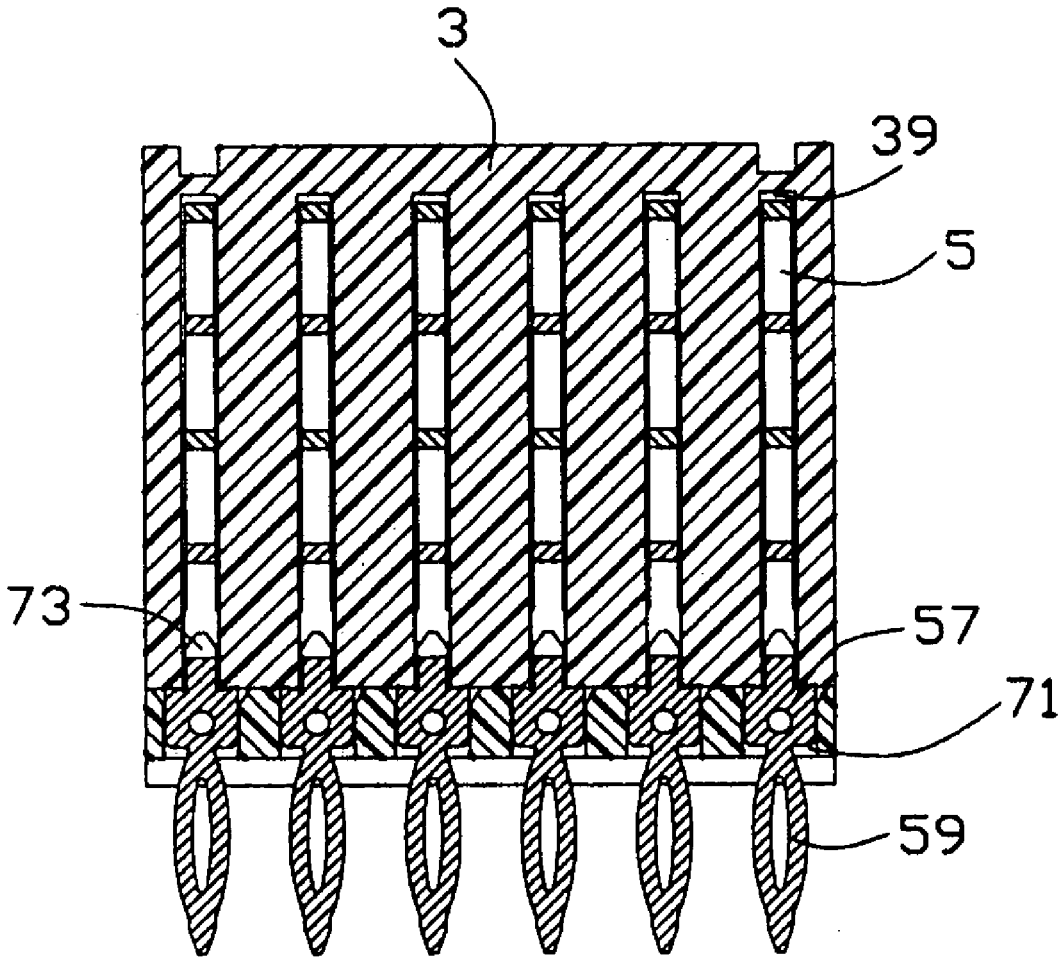
FIG. 7 is a sectional view of the backplane connector taken along line 7—7 in FIG. 1.

Referring to FIGS. 5, 6, 7, in assembly, the conductive terminals 5 are first mounted to the insulative housing 1 from a rear face of the insulative housing 1 with the mating portion 50 thereof being retained in the corresponding terminals holes 11. Then the spacer 7 is attached to the conductive terminals 5 from a bottom and the mounting portions 59 of the conductive terminals 5 are respectively received in the spacer holes 71. Finally, the press block 3 is mounted to the subassembly comprised by the housing 1, terminals 5 and the spacer 7 from a top with the columns of the terminals being retained in the corresponding receiving slots 39. The press portions 371 of the press block 3 engage the spacer holes 75 of the spacer 7. The barriers 73 are inserted into and retained between the corresponding receiving slots 39 and facilitate to hold the partition walls 37 in place. The protruding blocks 311 formed on the bottom of the lateral walls 31 of the press block 3 are retained in the wedge-shaped slots 81 to ensure firmly engagement between the press block 3 and the spacer 7.

The mating portions 50 of the conductive terminals 5 are retained in the terminal holes 11 of the insulative housing 1 and the shoulders 57 are retained in the corresponding spacer holes 71 of the spacer 7. In assembly the connector to the print circuit board, an insert force applied to the press block 3 is transmitted to the bending portions 55 of the conductive terminals 5 to make the mounting portions 59 of the conductive terminals 5 be moved into the printed circuit board and press-fitted therein.

The conductive terminals 5 receive an counteractive force when the mounting portions 59 of the conductive terminals 5 are pressed into the printed circuit board. The barriers 73 of the spacer 7 provided in this preferred embodiment are used for preventing the partition walls 37 of the press block 3 from deforming. Thus, it is ensured the shoulders 57 of the terminals 5 could not slip into the press block 3 along a reverse direction. The wedge-shaped slots 81 defined between the barriers 73 and the slant walls 77 to further prevent the lateral walls 31 of the press block 3 from deforming. The press portions 371 engages the spacer holes 75 of the spacer 7 for helping the mounting portions 59 to form steady electrical connections with the printed circuit board.

In addition, the angle defined between the top surface 571 of each of the shoulders 57 and the lateral surface 551 of each of the bending portions 55 is not bigger than 90 degree to avoid slipping of the shoulders 57 into the press block 3. Thus, the shoulders 57 of the conductive terminals 5 are positioned in the backplane connector and press block 3 firmly.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A backplane connector mounted on a printed circuit board comprising:

an insulative housing defining a plurality of terminal holes;

a plurality of conductive terminals each having a mating portion received in the insulative housing, a bending portion extending from the mating portion, a shoulder and a mounting portion mounted on the printed circuit board;

a press block comprising a plurality of partition walls and a plurality of slots defined by the partition walls; and a spacer defining a plurality of spacer holes for positioning the shoulders of the conductive terminals;

wherein the spacer forms at least one row barrier received in corresponding slots and holding the partition walls of the press block in place.

2. The backplane connector according to claim 1, wherein the press block forms a pair of protruding blocks on bottom surfaces of the outmost partition walls.

3. The backplane connector according to claim 2, wherein the spacer defines a pair of wedge-shaped slots for receiving the protruding blocks of the press block.

4. The backplane connector according to claim 1 wherein the press block forms a pair of press portions and wherein the spacer defining a pair of press slots receiving said press portions.

5. The backplane connector according to claim 1, wherein the mating portions of the conductive terminal comprises a connecting portion engaging with a mating connector and a fixing portion retained in the terminal hole.

6. The backplane connector according to claim 1, wherein an angle defined between a top surface of the shoulder and a lateral surface of the bending portions is not larger than 90 degrees.

7. A right angle electrical connector comprising:

rows and columns of terminals each comprising a mating portion, a right angel connecting portion and a mounting portion extending perpendicularly to the mating portion;

an insulative housing comprising a first housing accommodating said mating portions of said terminals and a second housing, said second housing defining a plurality of slots accommodating corresponding columns of right angel connecting portions; and a spacer defining holes for insertion therethrough corresponding mounting portions of said terminals and having a plurality of retaining members extending upwardly into corresponding slots of said second housing.

8. The right angle electrical connector according to claim 7, wherein the second housing forms a pair of press portions and wherein the spacer defining a pair of press slots receiving said press portions.

9. The right angle electrical connector according to claim 7, wherein the second housing forms a pair of protruding blocks on bottom surfaces of the outmost partition walls and wherein a pair of wedge-shaped slots defined on the spacer are employed for receiving said protruding blocks.

10. The right angle electrical connector according to claim 7, wherein the retaining member defines between at least a row of terminals and anther row of terminals, all of which are in close vicinity.

11. An electrical connector comprising:

an insulative housing defining a plurality of passageways therein;

a plurality of terminals disposed in the corresponding passageways, respectively;

a spacer located around a bottom portion of the housing with holes aligning tail tips of the terminals, respectively;

a press block with a plurality of partition walls and the associated receiving slots each between every adjacent two partition walls so as to align tail portions of the corresponding terminals; wherein the spacer defines upward protrusions extending into the corresponding slots for alignment between the spacer and the press block.

* * * * *